United States Patent [19]

Aston

[11] 4,447,773

[45] May 8, 1984

[54] ION BEAM ACCELERATOR SYSTEM

[75] Inventor: Graeme Aston, Montrose, Calif.

[73] Assignee: California Institute of Technology, Pasadena, Calif.

[21] Appl. No.: 276,076

[22] Filed: Jun. 22, 1981

[51] Int. Cl.[3] ..... H05H 5/02

[52] U.S. Cl. ..... 328/233; 313/360.1; 313/361.1; 313/363.1; 315/111.31; 315/111.81

[58] Field of Search ..... 328/233; 315/111.81, 315/111.31; 313/363.1, 361.1, 360.1; 250/492.2, 492.3

[56] References Cited

U.S. PATENT DOCUMENTS

| | | | |
|---|---|---|---|
| 3,852,633 | 12/1974 | Hunter | 313/411 |
| 3,999,097 | 12/1976 | Ko et al. | 313/361.1 |
| 4,028,579 | 6/1977 | King | 313/361.1 |

OTHER PUBLICATIONS

"Experimental Study of Ion Beamlet Steering . . . ," by Y. Okumura et al., *Review of Scientific Instruments*, vol. 51, No. 4, Apr. 1980, pp. 471–473.

*Primary Examiner*—Palmer C. Demeo

*Attorney, Agent, or Firm*—Freilich, Hornbaker, Rosen & Fernandez

[57] ABSTRACT

A system is described that combines geometrical and electrostatic focusing to provide high ion extraction efficiency and good focusing of an accelerated ion beam. The apparatus includes a pair of curved extraction grids (16, 18) with multiple pairs of aligned holes positioned to direct a group of beamlets (20) along converging paths. The extraction grids are closely spaced and maintained at a moderate potential to efficiently extract beamlets of ions and allow them to combine into a single beam (14). An accelerator electrode device (22) downstream from the extraction grids, is at a much lower potential than the grids to accelerate the combined beam.

11 Claims, 4 Drawing Figures

FIG. 2
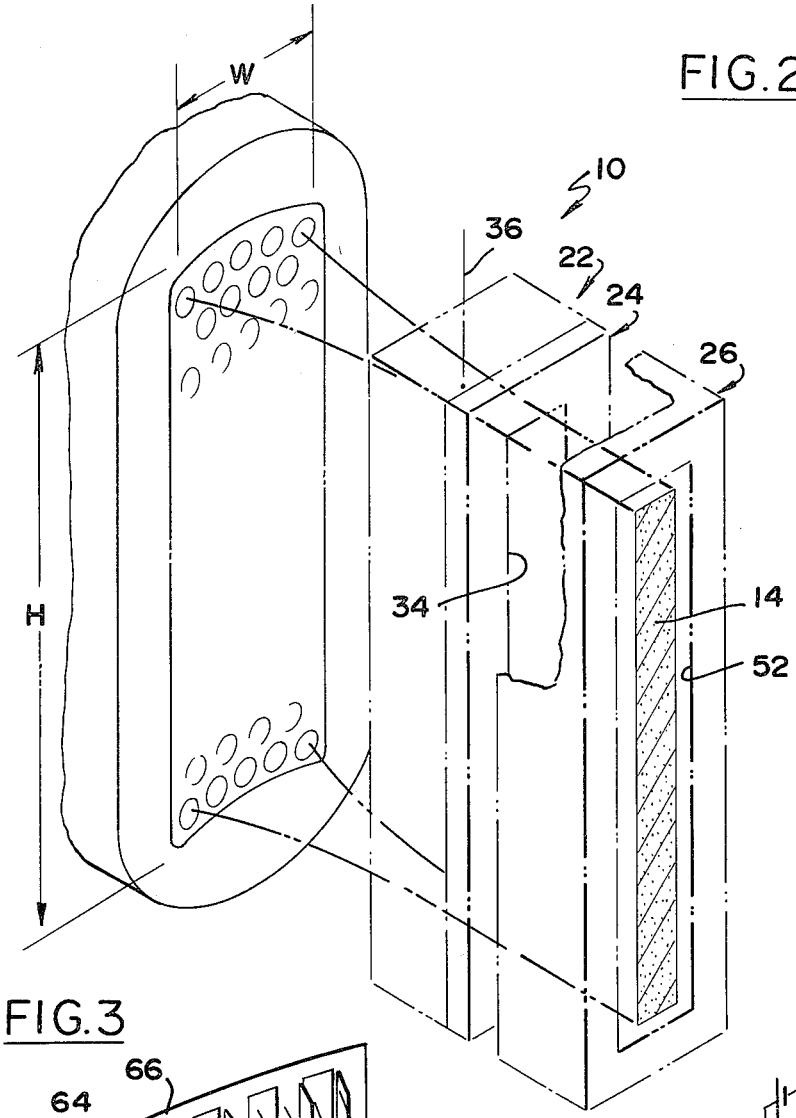
FIG. 3
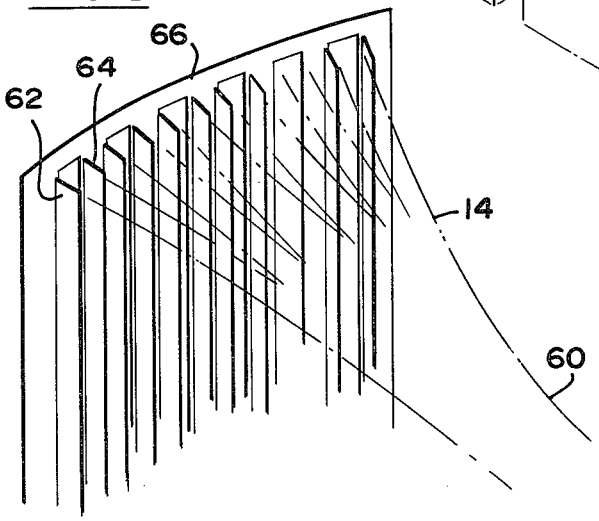
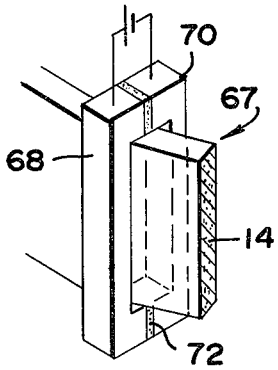
FIG. 4

ION BEAM ACCELERATOR SYSTEM

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

High intensity, high total energy, and well collimated ion beams are utilized in a variety of applications, particularly in ion implantation processes such as in doping semiconductors and implanting ions to passivate metal surfaces. An ion accelerator system which is commonly used includes an extraction grid or electrode with a narrow slit for extracting a slit-like ion beam, followed by accelerator and decelerator electrodes, and with a potential of many kilovolts between the extraction and accelerator electrodes to produce an accelerated ion beam. Experience has shown that such accelerator systems are limited in beam intensity and focusing, which results in excessively long implantation process times in many applications. An ion beam accelerator system which could produce higher beam current densities with high efficiency and good collimation, would be of value in ion implantation applications, as well as other applications which utilize ion beams.

SUMMARY OF THE INVENTION

In accordance with one embodiment of the present invention, an ion beam accelerator system is provided, for extracting and accelerating ions from a source to produce an ion beam of high current density. The system includes a pair of slightly spaced extraction grids with convex faces facing towards an ion source, and with the grids having aligned pairs of holes for extracting ion beamlets. The pairs of holes are positioned so that the beamlets converge, to enable them to converge into a single beam. The extraction grids are closely spaced and maintained at only a moderate voltage between them, to only moderately accelerate the beamlets. The grids are followed by an accelerator electrode device, including an electrode with a hole large enough to pass the merged beamlets and which is at a much lower potential than the grids, for energetically accelerating the ions.

The novel features of the invention are set forth with particularity in the appended claims. The invention will be best understood from the following description when read in conjunction with the accompanying drawings.

BRIEF DESCRIPTION OF THE DRAWINGS

FIG. 2 is a partial perspective view of the system of FIG. 1.

FIG. 3 is a partial perspective view of another ion beam accelerator system.

FIG. 4 is a partial perspective view of another ion beam accelerator system.

DESCRIPTION OF THE PREFERRED EMBODIMENTS

Figure 1:
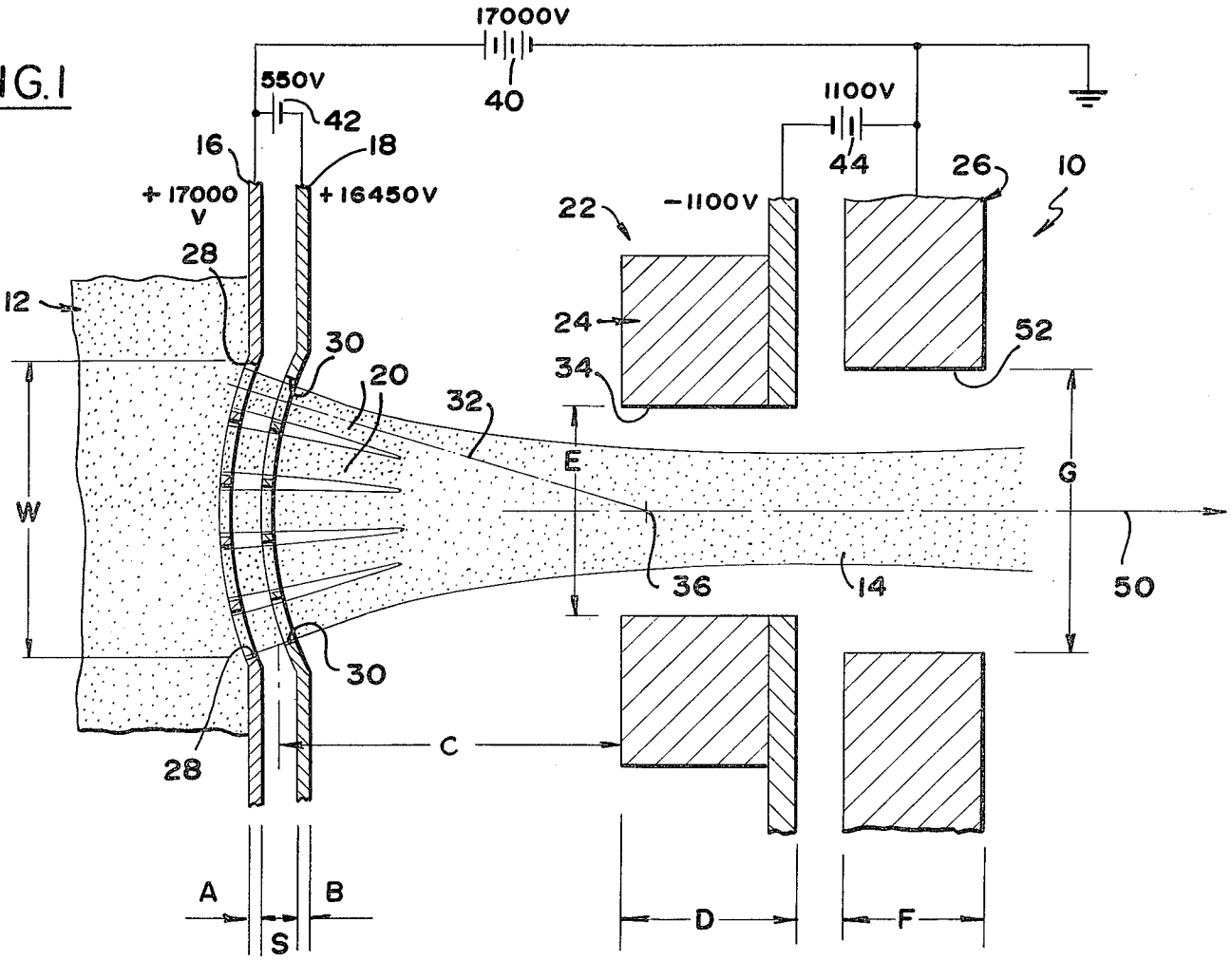
FIG. 1 is a partial sectional view of an ion beam accelerator system constructed in accordance with the present invention.

FIGS. 1 and 2 illustrate an ion beam accelerator system 10 which can be utilized to extract ions from an ion source 12 and accelerate the extracted ions to form an ion beam 14 of high beam current density that is suitable for a variety of processes, particularly in ion implantation applications. A variety of well-known ion source devices are available to produce the ion source 12. One such apparatus includes a hollow cathode through which the gas to be ionized passes, and with electrons being emitted from an end of the cathode towards an anode to ionize gas emerging from the hollow electrode, to provide the ions to be formed into a beam by the present system.

The accelerator system 10 includes a pair of extraction grids 16, 18 which efficiently extract ions from the source 12 to form beamlets 20 of ions accelerated to a low to moderate energy. The system also includes an accelerator electrode device 22 having a pair of electrodes 24, 26 that acclerate the combined beamlets to a high energy level.

The two extraction grids 16, 18 are formed with numerous small holes 28, 30 through which narrow beams or beamlets of ions can pass. The downstream or focusing grid 18 is maintained at a negative potential such as a few hundred volts below the upstream or screen grid 16, so that ions from the source 12 pass through the grid 16 by attraction to the potential within the holes of the second grid 18. However, the moderate voltage difference accelerates the beamlets 20 to only a relatively low energy level. The ion flow, or current, of each beamlet 20 is relatively low, and higher densities are achieved by merging the beamlets 20 into the single beam 14. This is accomplished by curving the grids 16, 18, and positioning their respective holes 28, 30 so that a pair of corresponding holes in the two grids are aligned in a direction to from a group of converging beamlets. This can be accomplished by aligning the holes such as 28, 30 so that a beamlet path 32 passing through the two holes reaches a common focus 36, for all of the corresponding pairs of holes in the extraction grids.

In the accelerator electrode device 22, the upstream electrode 24 is maintained at a large negative potential with respect to the extraction grids 16, 18, to create a potential within the hole 34 of the electrode that accelerates the beamlets and combined beam to a high energy. The downstream electrode 26, which may be referred to as a deceleration electrode because it is at a positive potential with respect to the accelerating electrode 24, is used to provide a grounded ion beam. Such grounding minimizes defocusing of the beam 14, because it brings all portions of the ion beam 14 to ground potential uniformly. The negative potential of the accelerator electrode 24 is utilized to prevent backward or upstream flow of electrons that are created when the ion beam 14 strikes a workpiece.

FIG. 1 shows how the various voltages of the parts of the system can be established, as by utilizing a high voltage source 40 such as of 17,000 volts that maintains the screen grid 16 at a large potential above ground to provide a large voltage drop for accelerating the ion beam. Another voltage source 42 maintains the focusing grid 18 at a moderate voltage such as 550 volts below the screen grid 16. A third voltage source 44 maintains the accelerator grid electrode 24 at a negative voltage with respect to the ground potential of the deceleration electrode 26.

The width W of the extraction grids, such as the screen grid 16, should not be more than about one centimeter (i.e. less than two centimeters) or else large backstreaming of electrons from the beam plasma to the extraction grids can occur (in the presence of the accelerator electrode 24 which is at a much lower potential). Accordingly, the width of the ion beam 14 obtained from the device is limited, as to a 1/e width (i.e. where ion density is at 0.37 of the density at the center of the beam) of about one-half centimeter. To achieve a considerable beam current, the extraction grids 16, 18 are constructed, as shown in FIG. 2, with a height H much greater than their width W, such as 5 times as great. This produces a slit-shaped beam 14. It is found that the resulting beam 14 is well collimated both in height and width.

The extraction efficiency of the extraction grids 16, 18 is enhanced by utilizing grids which are very thin and maintained very close together. Thin grids, and especially a thin screen grid 16, increases the efficiency with which ions are extracted from the ion plasma source 12, since a thin screen grid reduces ion recombination losses on the walls of the grid holes 28. It is desirable to maintain the grids 16, 18 as close together as practical to maximize the ion field current. The extracted ion current density increases as a function of $(V^{3/2}/S^2)$, where V is the voltage between the grids and S is the separation between the grids. Since the maximum voltage that can be applied before there is arcing, is proportional to the grid separation, it can be seen that the extracted ion current density increases as the extraction grid separation S decreases (assuming that the voltage is adjusted so the electric field between the grids is maintained at a constant value).

In one ion accelerator that has been constructed, both of the extraction grids 16, 18, were formed of graphite, which is useful to stand up to the high temperatures such as 1,000° F. to which the grids are subjected. The screen grid 16 had a thickness A of 18 mil (one mil equals 0.001 inch), the focusing grid 18 had a thickness B of 22 mil, and the grids were separated by a distance S of 60 mil as measured along the beam centerline 50. Each of the holes 28, 30 in the grids were drilled to a diameter of 82 mil, and the centerlines of the holes in each grid were spaced by about 100 mil. The holes were formed in staggered rows with four or five holes in each row, to form a hexagonal pattern wherein each hole (except those at the edges) is equally spaced from six adjacent holes. The distance C between the extraction grids and the accelerator electrode device, as measured along the beam centerline 50, was 0.6 inch. The accelerator grid 24 had a thickness D of 0.31 inch and a hole width E of 0.375 inch. The deceleration electrode 26 had a thickness F of 0.24 inch and a hole width G of 0.50 inch. Both of the holes 34, 52 in the electrodes had a height of 1⅜ inches, which is slightly greater than the heigth of the matrix of holes in the extraction grids. The apparatus was fed with Xenon gas at a rate of 0.35 standard cubic centimeters per minute into the ion beam plasma source 12 and there was almost 100% extraction of the ions into the beam 14. Ion beams were produced having a centerline density of over 500 $A/_{cm}^2$ and a beam divergence of less than one degree.

In constructing and testing the accelerator system 10, it was found that care must be taken in designing the geometry of the extraction grid apparatus and the voltages applied between the grids, to assure that the beamlets 20 merge into a single beam. If the ion current in each beamlet 20 is too small, then the beamlets 20 will pass across one another instead of merging into a single beam 14. On the other hand, if the beamlet currents are too large, then the combined beamlets form a beam that fans out or diverges at a large angle. The moderate voltage such as 550 volts between closely spaced extraction grids, and the size of the holes such as 28 in the screen grid, provide beamlets that merge, while allowing a large voltage drop to the accelerator electrode device 22 to further accelerate the beam.

Although the single slit-shaped ion beam 14 produced by the above-described system is useful in many applications, it is often desirable to provide a collimated beam of much greater current. This can be accomplished, as by the apparatus of FIG. 3, wherein the beams 14 from several of the ion beam accelerator systems of the type shown in FIG. 1 can be combined into one higher current beam 60. This can be accomplished by utilizing a pair of electrostatic beam deflection plates 62, 64 on either side of each beam 14 as it emerges from its corresponding decelerator electrode such as 66 which is similar to the electrode 26 of FIG. 1. The deflection plates 62, 64 are maintained at different voltages to deflect the ion beam 14 to one side, to merge with the other ion beams. In another merging apparatus, of which part is shown in FIG. 4, the decceleration electrode 67 near the downstream end of each ion beam accelerator can be split in half, with the two halves 68, 70 separated by an insulation 72. Such an electrode is utilized in place of the accelerator electrode 24 in FIG. 1. The two halves 68, 70 are maintained at a different voltage, as by maintaining the half 68 at minus 300 volts and the other half 70 at minus 300 volts, with respect to the grounded decelerator electrode (not shown, and therefore serve to electrostatically deflect the ion beam. A group of ion beam accelerators can be set up so they are positioned beside one another as in FIG. 3, to merge the group of beams 14 into one higher current beam.

Thus, the invention provides an ion beam accelerator system which efficiently extracts and accelerates ions to produce an ion beam of high current density, high total current, and good collimation. This is accomplished by utilizing a pair of extraction grids which are closely spaced and at a moderate potential difference to extract ion beamlets, and with the grids having pairs of holes aligned so that the beamlets merge. The extraction grids are both held at a high potential above ground, so that the beam formed by the combined beamlets can be accelerated to a high voltage by an accelerator electrode device. The beam formed by the combined beamlets, can, in turn, be combined with other beams to form a large ion beam current by sidewardly deflecting a group of slit-shaped beams.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. An ion beam accelerator system for accelerating ions of an ion source, comprising:

a pair of slightly spaced extraction grids having upstream faces facing the ion source, a first of said grids being positioned upstream from a second of said grids, said grids forming a plurality of pairs of holes, one in each grid, with said pairs of holes aligned in directions to form a plurality of converging beamlet paths;

an accelerator electrode device spaced downstream from said extraction grids by more than twice the space between said pair of grids, including a first electrode with a hole for passing said beamlets; and means for establishing said second grid at a negative potential relative to said first grid, and for establishing said first accelerator electrode at a negative potential with respect to both of said grids, the potential difference between either grid and said first electrode being a plurality of times greater than the potential difference between said pair of grids.

2. The system described in claim 1 wherein:

said first and second extraction grids are separated by less than one millimeter, and the potential between them is no more than about 550 volts, whereby to maximize the ratio of electric field between grids to voltage between grids.

3. The system described in claim 1 wherein:

said pairs of holes are positioned so that said beamlet paths converge substantially toward a predetermined focal point, as viewed in a predetermined sectional view of the grids; and said first accelerator electrode is located approximately at said focal point.

4. The system described in claim 1 wherein:

said grids are substantially cylindrically curved about a height axis extending perpendicular to said upstream-downstream directions; and each of said grids has a length, in a direction parallel to said height axis, which is at least twice as great as its width; and said hole in said first electrode has a height in a direction parallel to said height axis, which is at least twice as great as its width.

5. Apparatus for forming and accelerating an ion beam comprising:

screen and focusing grids, each having an extraction portion curved substantially about a predetermined focal point, as seen in a predetermined sectional view, said focal point located downstream from said grids and said focusing grid lying downstream from said screen grid, said grids having holes arranged to form beamlet paths that each pass through a hole in each grid and substantially through said focal point;

an accelerator device located downstream from said grids, including an accelerator electrode and a decelerator electrode located downstream of said accelerator electrode, said accelerator electrode having a hole which is aligned with a beam axis which extends through said focal point and the middle of the curved extraction portions of said grids; and means for establishing said screen grid at a first large positive voltage, said focusing grid at a second voltage which is negative with respect to said screen grid, said decelerator electrode at a third voltage which is negative with respect to said second voltage, and said accelerator grid at a fourth voltage which is positive with respect to said third voltage and negative with respect to said second voltage;

said grids lying much closer together than the distance between said grids and said accelerator electrode.

6. The apparatus described in claim 5 wherein:

said extraction portions of said screen and focusing grids have a length, in a direction which is perpendicular to said beam axis and which extends along a height axis extending normal to the plane of said sectional view, which is greater than its width as seen in said sectional view.

7. A method for extracting and accelerating ions from an ion source, comprising:

extracting and slightly accelerating by a potential drop of less than 1000 volts, a plurality of ion beamlets from said source along a plurality of paths that converge into an ion beam while maintaining the ions in said beamlets at a high potential above ground before they merge;

applying a much lower potential of more than 1000 volts below the potential of said beamlets before they converge, to a location immediately around the beamlets to accelerate them, at a location downstream from where they were slightly accelerated.

8. The method described in claim 7 wherein:

said step of extraction includes applying a voltage of less than 1000 volts between a pair of grids which are matingly convexly curved on faces thereof facing toward said ion source, while maintaining said grids at a small spacing, and said step of applying a much lower potential includes applying said lower potential to an electrode spaced downstream of said grids by more than twice the spacing between said grids.

9. The method described in claim 7 wherein:

said step of extracting includes extracting ion beamlets from locations within an extraction area along the periphery of said source, which has a width of less than two centimeters and a height which is more than twice the width, and converging said beamlets substantially toward an imaginary strip that is narrower than said extraction area width and that extends parallel to the height of said extraction area; and said step of applying a much lower potential includes applying said voltage to an electrode having a hole with a width and with a length at least twice its hole width.

10. An ion beam accelerator system for accelerating ions of an ion source, comprising:

a pair of slightly spaced extraction grids having upstream faces facing the ion source, a first of said grids being positioned upstream from a second of said grids, said grids forming a plurality of pairs of holes, one in each grid, with said pairs of holes aligned in directions to form a plurality of converging beamlet paths;

an accelerator electrode device spaced downstream frm said extraction grids, including a first electrode with a hole for passing said beamlets;

means for establishing said second grid at a negative potential relative to said first grid, and for establishing said first accelerator electrode negative with respect to both of said grids, said grids each have holes arranged on an area having a width of less than two centimeters and a height which is a plurality of times greater than its width, and said first electrode hole has a height which is a plurality of times greater than its width, to form a slit-shaped accelerated ion beam;

means for forming a plurality of said slit-shaped ion beams, with their heights all substantially parallel; and means for deflecting a plurality of said slit-shaped beams to converge them into a single beam.

11. The system described in claim 10 wherein:

said first electrode includes first and second opposite sides which are insulated from each other, and said means for deflecting includes means for maintaining said opposite sides at a different electrical potential.

* * * * *